US005088532A

United States Patent [19]

Eggers et al.

[11] Patent Number: 5,088,532

[45] Date of Patent: Feb. 18, 1992

[54] MATERIAL FEED CONTROL METHOD AND APPARATUS FOR A WOOD OR BRUSH CHIPPING MACHINE

[75] Inventors: Thomas A. Eggers; Alan J. Yoder, both of Pella, Iowa

[73] Assignee: Vermeer Manufacturing Company, Pella, Iowa

[21] Appl. No.: 533,370

[22] Filed: Jun. 5, 1990

[51] Int. Cl.[5] ..... B27C 1/00; B27B 1/00

[52] U.S. Cl. ..... 144/356; 144/176; 144/246 R; 144/246 G; 144/369; 198/624; 198/626.3; 198/861.1; 241/101.7; 241/222

[58] Field of Search ..... 198/624, 855, 857, 628; 144/176, 246 R, 246 G, 356, 369; 241/222, 101.7

[56] References Cited

U.S. PATENT DOCUMENTS

| | | | |
|---|---|---|---|
| 3,524,485 | 8/1970 | Smith | 144/176 |
| 4,534,390 | 8/1985 | Morey et al. | 144/176 |
| 4,598,745 | 7/1986 | Parviainen | 144/176 |
| 4,865,094 | 9/1989 | Stroud et al. | 144/356 |

*Primary Examiner*—W. Donald Bray
*Attorney, Agent, or Firm*—Kent A. Herink; Brian J. Laurenzo

[57] ABSTRACT

A method and mechanism for controlling the material feed of a machine for chipping wood or brush. The machine has a pair of coacting feed rolls which feed material to be chipped into a rotating chipper that is driven by an engine of variable speed. Hydraulic motors for driving each of the feed rolls are actuated when the speed of the engine is at least a selected high level appropriate for efficient chipping. If the material is of a size or composition to load the engine below a selected low level adverse to efficient chipping, the hydraulic motors are interrupted to stop feeding of the material to allow the engine to return to an efficient chipping speed. When the engine has recovered to at least the selected high level, the hydraulic motors are reactivated to again feed material into the chipper.

10 Claims, 5 Drawing Sheets

MATERIAL FEED CONTROL METHOD AND APPARATUS FOR A WOOD OR BRUSH CHIPPING MACHINE

BACKGROUND OF THE INVENTION

The invention relates generally to wood or brush chipping machines and, more specifically, to a mechanism and method for automatically controlling the feeding of wood or brush into the machine to ensure efficient chipping.

Wood and brush chippers of the type having a rotating chipping disk and a pair of coacting feed rolls for feeding the wood or brush into the chipping disk are well known. One such device is described in U.S. Pat. No. 4,442,877. The chipping efficiency of such machines depends on the maintenance of a high rotational speed of the chipping disk and on the "bite" or kerf that the chipping disk removes from the infeeding wood or brush. Efficiency is reduced if the speed of the chipping disk is reduced due to lugging of the drive engine of the chipper disk or if the wood or brush is not aggressively moved into the chipping disk so that frictional rubbing and burning of the wood or brush occurs rather than the removal of material by chipping. Manual intervention by the operator is required to interrupt the feed rolls to avoid killing the engine of the chipping machine and to allow the engine to return to an efficient chipping speed.

The present invention automatically interrupts the rotation of the feed rolls in response to low engine rpm so that engine horsepower is maintained at an efficient level and so that continual manual attention is not necessary and to free the operator for gathering and feeding of material into the chipping machine.

SUMMARY OF THE INVENTION

The invention provides a wood or brush chipping machine wherein a pair of power driven feed rolls, located within a material feed chute or housing, are mounted for rotation about vertical axes located forwardly of the inlet of the chute for feeding material into the side of a disc-type cutter rotatable in a vertical plane forwardly of the chute outlet. A first feed roll is held in a fixed location and the second feed roll is pivotally supported for yieldable movement transversely of the feed chute relative to the first feed roll to receive therebetween the wood or brush material to be chipped. The chute has its longitudinal axis inclined about 45° relative to the rotational plane of the cutter. The swinging or pivoted movement of the second feed roll engages the material to maintain material feeding movement into the cutter.

Each feed roll is driven by a reversible hydraulic motor which is actuated by a control mechanism that is responsive to the rpm of the drive engine of the cutter. If the drive engine is slowed as a result of over-feeding of material or because the material is rubbing against the cutter rather than being chipped by it, the control mechanism promptly stops the hydraulic motors of the feed rolls. Upon recovery of the cutter drive engine, the control mechanism restarts the feed rolls.

DETAILED DESCRIPTION OF A PREFERRED EMBODIMENT

Figure 1:
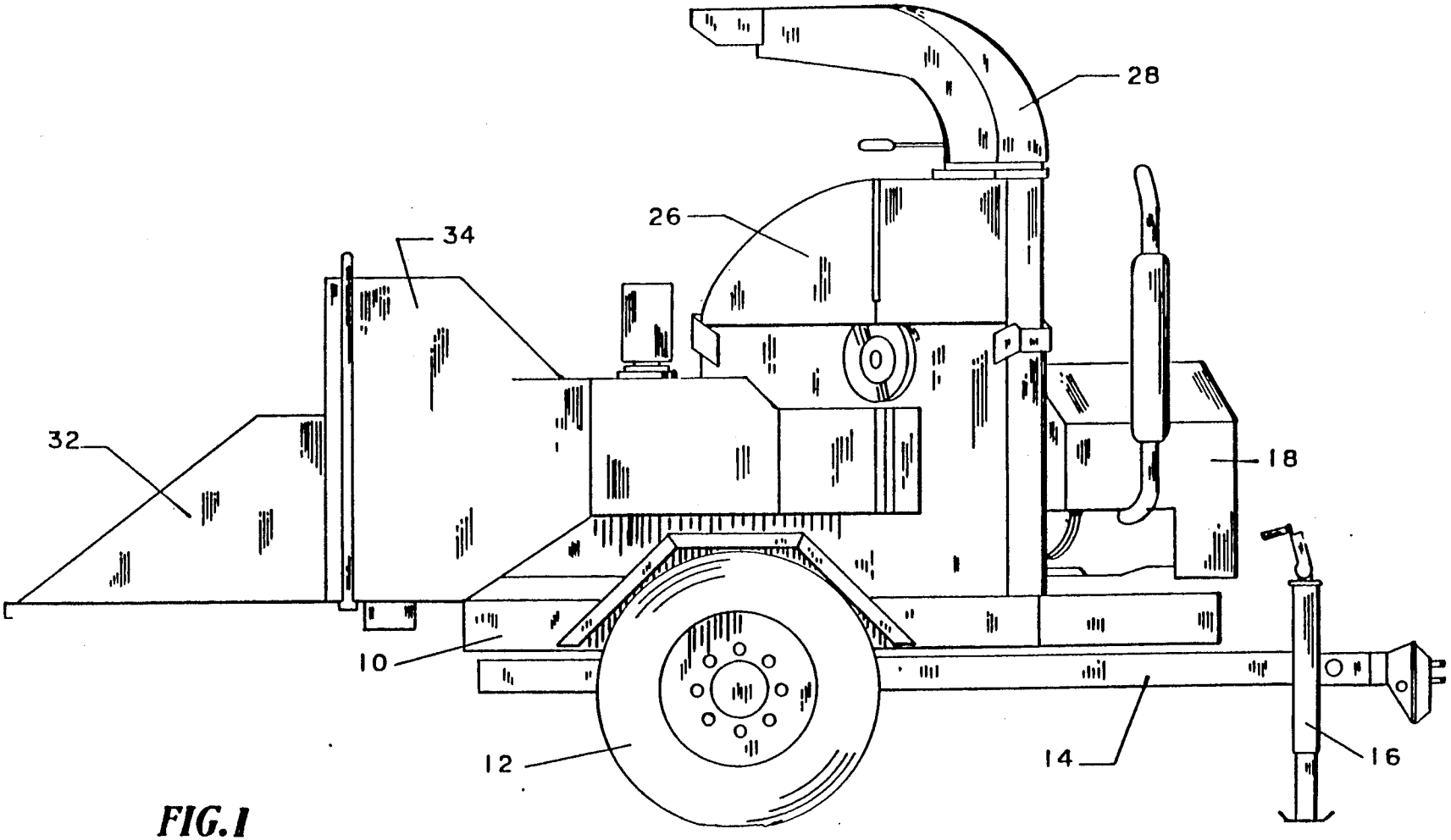
FIG. 1 is a side view of a brush chipping machine embodying the material feed control of the present invention.

Referring to FIG. 1, there is illustrated a brush chipping machine that has a main frame 10 carried on a pair of wheels 12 (only one of which is shown). A tongue 14 is connectable to a towing vehicle (not shown) for moving the machine to different operating areas. If the chipping machine is disconnected from the towing vehicle, a jack 16, mounted on the tongue 14, is manually actuated to maintain a desired level of the machine during operation.

Mounted on the frame 10 is an engine 18 which is in a belt driving connection 20 with a disk-type cutter or chipper 22 (FIGS. 2 and 3) rotatable in a vertical plane about a horizontal axis or shaft 24. The chipper 22 is enclosed in a housing 26 having a discharge chute 28 to receive the chipped product from the chipper 22 and to direct the product away from the chipping machine. A deflector hood 30 is movably mounted on the discharge end of the discharge chute 28 in a manner such that chips may be deflected in a variety of vertical directions.

Figure 2:
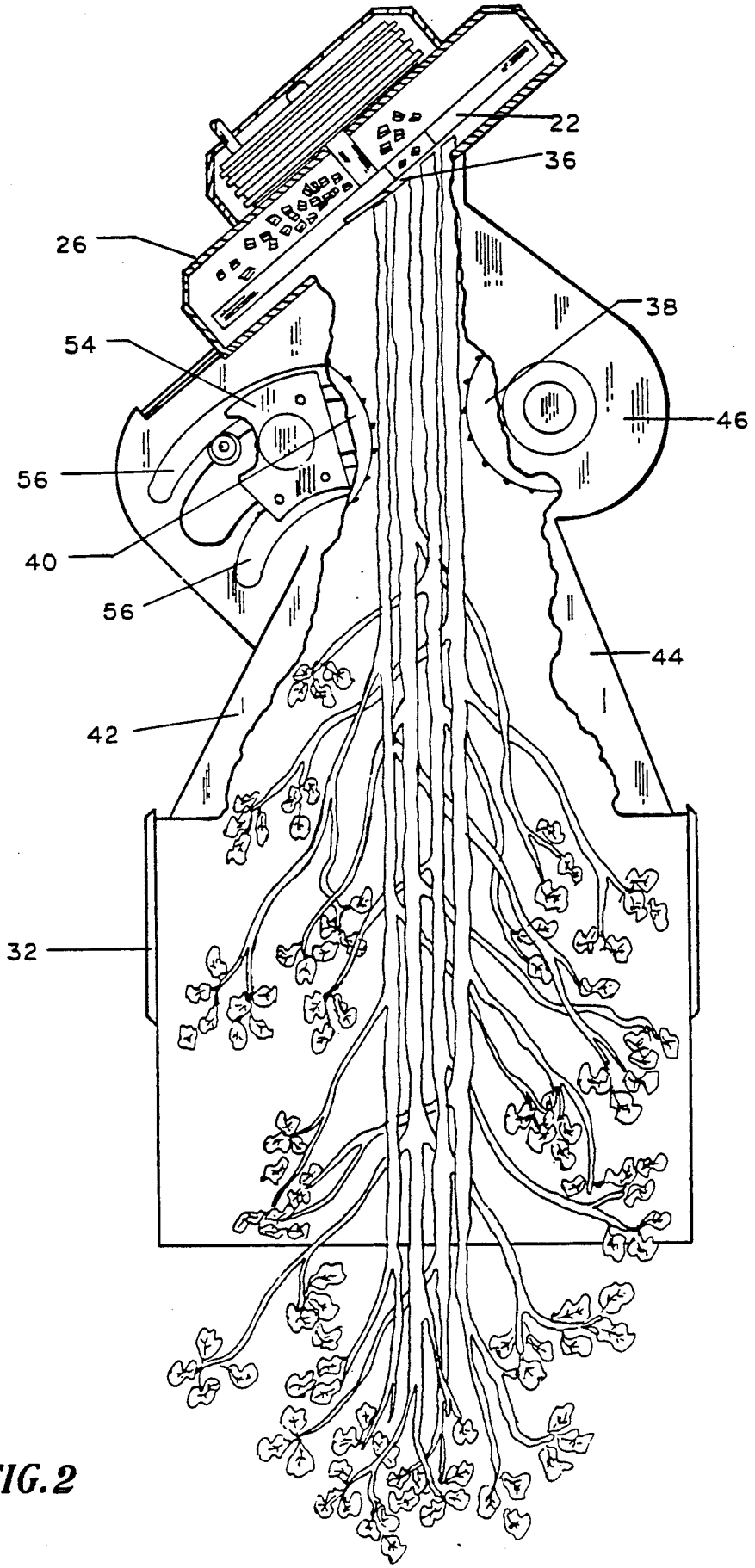
FIG. 2 is a plan view of the brush chipping machine in operation with parts broken away to show the feed rolls and chipper disk.
Figure 3:
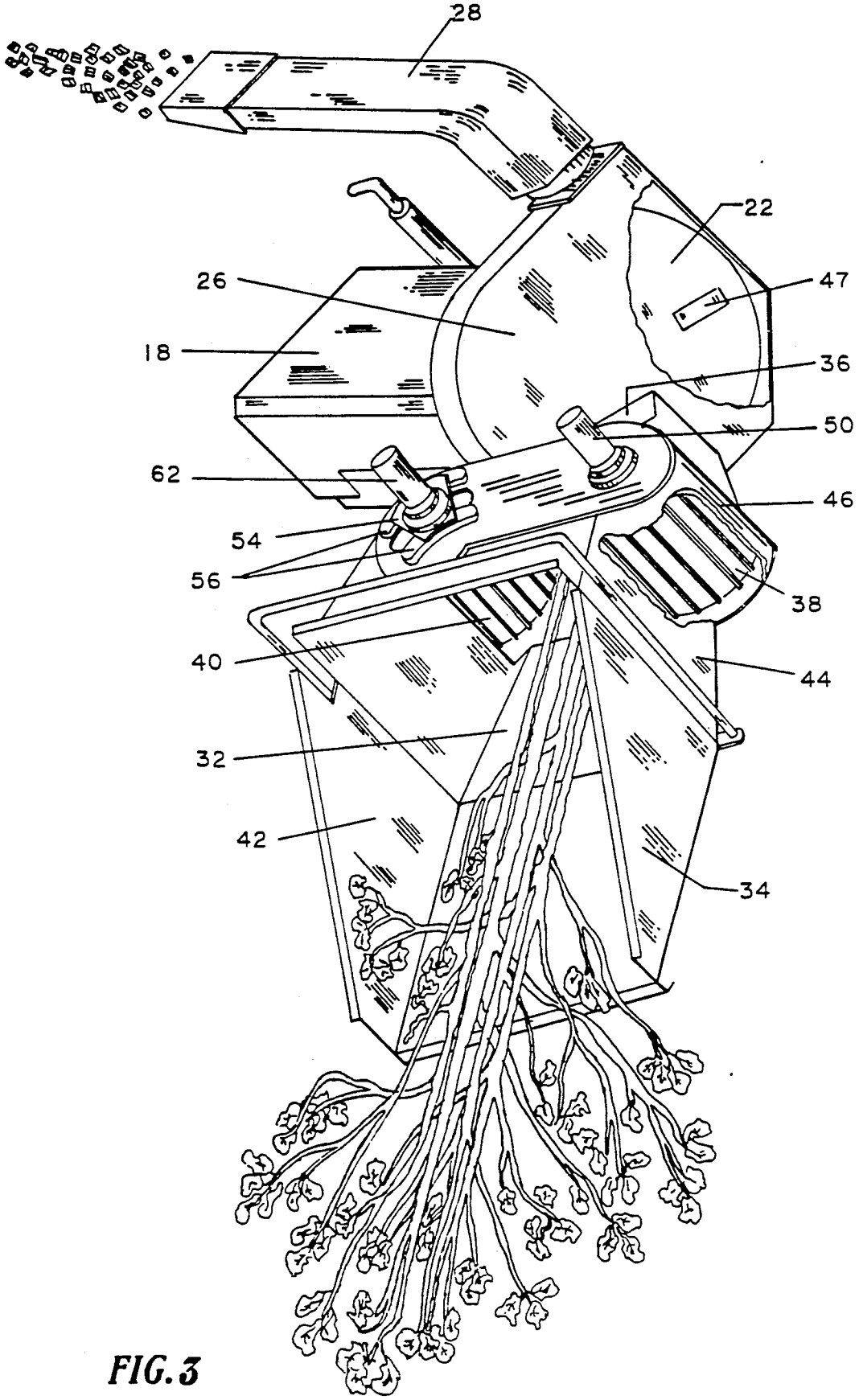
FIG. 3 is a perspective view showing the assembly relation of the material feed rolls with the chipper disk and the material feed chute.

The material to be chipped is fed into a housing unit or feed chute 32 which is of a generally tubular form and of a rectangular shape in transverse cross section. The feed chute 32 is mounted on the main frame 10 and has an inlet 34 for receiving material to be chipped and an outlet 36 (FIGS. 2 and 3) of a reduced size relative to the inlet 34 and located adjacent to and open to one side of a pair of feed rolls, stationary feed roll 38 and swinging feed roll 40. The feed chute 32 has side walls 42 and 44 that taper inwardly from the inlet 34 to the outlet 36 and a horizontal longitudinal axis oriented at about 45° to the vertical plane of rotation of the chipper 22 so that material to be chipped is directed into a lower quadrant portion of the chipper 22 which is provided with a plurality of projected cutting members 47 (FIG. 3). The chipper housing 26 is open to the feed chute outlet 36 at the lower quadrant portion of the chipper 22.

Material supplied to the feed chute 32 at the inlet 34 is fed toward the lower quadrant portion of the chipper 22 by the pair of upright feed rolls 38 and 40 arranged opposite each other transversely of the feed chute 32 adjacent the outlet 36. Each feed roll 38 and 40 has a serrated or toothed outer peripheral surface for gripping and engaging material fed into the feed chute 32. The feed roll 38 is stationary and positioned within an alcove 46 such that a portion of the stationary feed roll 38 projects inwardly of the side wall 44. A shaft for the feed roll 38 is rotatably mounted in the upper wall of the alcove 46 with the upper end of the shaft in direct driven engagement with a reversible hydraulic motor 50.

The feed roll 40 is movable transversely of the feed chute 32 toward and away from the stationary feed roll 38 in response to material fed between the rolls 38 and 40. A shaft of the feed roll 40 is rotatably mounted at its top end in a mounting plate 54 (FIG. 2). The mounting plate 54 is supported for rolling movement in a double track 56 formed in the top wall of the feed chute 32 to provide for movement of the movable feed roll 40 toward and away from the stationary feed roll 38 (FIG. 3). The shaft of the movable feed roll 40 is in direct driven engagement with a reversible hydraulic motor 62.

In the operation of the chipping machine, the feed rolls 38 and 40 are rotated in the direction to feed material toward the chipper 22. The material to be chipped is initially manually introduced at the inlet 34 and moved until engagement is made with the feed rolls 38 and 40. In response to such feeding action, the movable feed roll 40 is moved against the action of a spring and cable assembly (not shown) in a direction away from the stationary feed roll 38 to accommodate therebetween the material to be chipped. The movable feed roll 40 is moveable to a maximum moved position relative to the stationary feed roll 38 so as to open substantially the full transverse cross-sectional area of the feed chute 32 to the incoming material to be chipped.

The rotational speed of the feed rolls 38 and 40 controls the quantity of material being fed to the chipper 22. For chipping large material, a low feed rate and therefore low rotational speed of the feed rolls is desired. For chipping small material, however, a higher feed rate and rotational speed is desired to fully utilize the capacity of the chipping machine. If the material is being fed too aggressively by the feed rolls 38 and 40 into the chipper 22, the engine 18 will be slowed outside the efficient operating range for chipping. By interrupting feeding of material by stopping the feed rolls 38 and 40, the engine 18 is allowed to recover. After the rpm of the engine 18 has recovered and the chipper 22 is at full speed again, the feed rolls 38 and 40 are actuated to resume feeding of material. With large material, rotation of the feed rolls 38 and 40 will be more frequently interrupted than with small material.

Figure 4:
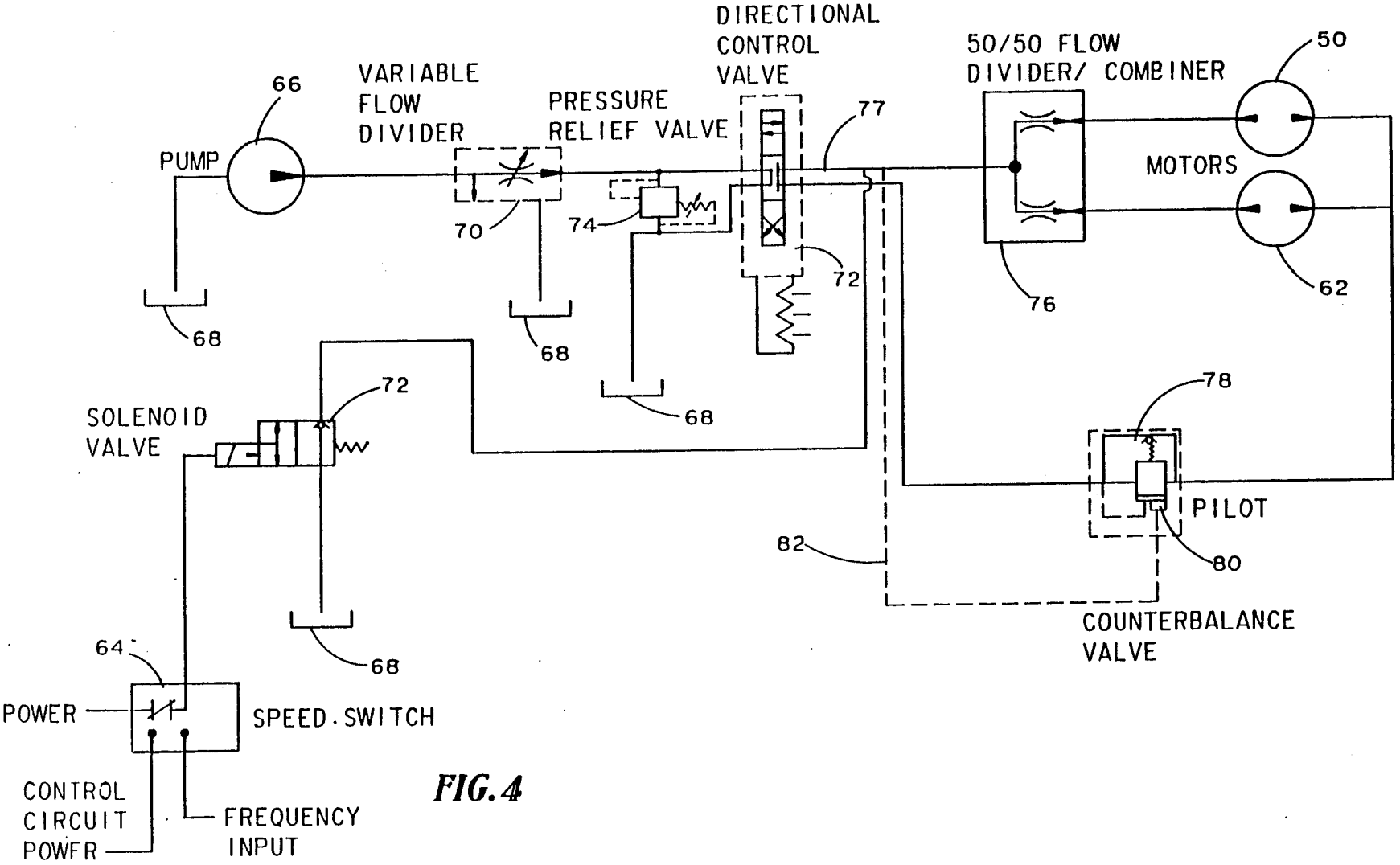
FIG. 4 is a schematic diagram of the material feed control.

A schematic diagram of the electrical and hydraulic feed control system for automatically maintaining efficient operation of the chipping machine is illustrated in FIG. 4. An hydraulic pump 66 is driven by the engine 18 (FIGS. 1 and 2) of the chipping machine. The hydraulic pump 66 supplies pressurized fluid from a reservoir 68 to the hydraulic motors 50 and 62 for the feed rolls. Pressurized hydraulic fluid from the pump 66 is directed to a variable flow divider 70 which is manually adjustable to divert or bypass a selected amount of hydraulic fluid back to the reservoir 68 to permit regulation of hydraulic pressure and flow downstream of the variable flow divider 70. Because the rotational speed of the hydraulic motors 50 and 62 is proportional to the hydraulic fluid flow, the rotational speed of the motors 50 and 60 is regulated by adjustment of the variable flow divider 70.

Pressurized fluid from the variable flow divider 70 is directed to a directional control valve 72 which is manually operated to select the direction of rotation of the hydraulic motors 50 and 62. In normal operation, the hydraulic motors 50 and 62 will be operated in the direction to rotate the feed rolls 38 and 40 in the direction to feed material into the chipper disc 22 (FIG. 3). If it is necessary to remove material to be chipped from the chipper machine, the feed rolls can be reversed by movement of the directional control valve 72 to reverse the flow of pressurized hydraulic fluid to the hydraulic motors 50 and 62. A pressure relief valve 74 is provided at the input of the directional control valve 72 to provide a relief of hydraulic fluid back to the reservoir 68 when an overload of pressure occurs, for example if the feed rolls are locked up by material to be chipped.

Pressurized fluid from the directional control valve 72, when in its normal operative mode, is directed to a 50/50 flow divider/combiner 76 via hydraulic line 77. The divider/combiner 76 assures that an equal supply of the pressurized fluid is supplied to each of the hydraulic motors 50 and 62. Fluid returns to the directional control valve 72 through a motion control valve or counterbalance and hold valve 78 which includes a pilot 80. A pilot hydraulic line 82 leads from the hydraulic line 77 interconnecting the directional control valve 72 and the divider/combiner 76 to the pilot 80. When greater than a preselected pressure of hydraulic fluid is present at the pilot 80, the counterbalance valve 78 is open and will allow the flow of hydraulic fluid. If the hydraulic fluid at the pilot 80 has less than the threshold pressure, the counterbalance valve 78 will quickly close and block the flow of hydraulic fluid. Closure of the counterbalance valve 78 acts, accordingly, as a brake on the hydraulic motors 50 and 62. An electrically actuated solenoid valve 72 is connected to the hydraulic line 77 and functions as described below to selectively reduce the hydraulic pressure at the pilot 80. Of course, when the directional control valve 72 is moved to the reversed position, pressurized hydraulic fluid will then be directed from the directional control valve 72 to the counterbalance valve 78, through the motors 50 and 62, back to the directional control valve 72 through the divider/combiner 76, and returned to the reservoir 68. In reverse operation, the counterbalance valve 78 does not close in response to low pressure at pilot 80, but remains open.

As described above, it is desirable to maintain the engine rpm and hence the rotational speed of the cutter disk within a narrow range. An electronic speed switch 64 receives an input frequency signal from the engine. The input frequency signal corresponds to the rpm of the engine and may be taken from the alternator of a diesel engine or the ignition system of a gasoline engine depending on the type of engine used in the chipper machine. The input frequency signal is monitored electronically within the speed switch 64. A range of engine speed or rpm is selected for most efficient chipping operation and the speed switch 64 is adjusted to open and close at the limits of that selected rpm range to stop and restart the feeding action.

Electrical power for operating the normally closed solenoid valve 72 is switched by the speed switch 64 which is also normally closed. At low engine rpm, accordingly, the speed switch 64 is closed and the solenoid valve 72 is energized to its open position, wherein it acts as a shunt valve to shunt pressurized hydraulic fluid from the pump 66 back to the reservoir 68. When the pressure to the variable flow divider 70 and the remainder of the hydraulic circuit is thus relieved, the pressure in the hydraulic line 77 and pilot line 82 is below the threshold of the pilot 80, causing the counterbalance valve to be in the closed position so that the hydraulic motors 50 and 62 are not being driven.

When engine rpm exceeds the preselected level, the speed switch 64 will open, cutting off electrical power to the solenoid valve 72 which will then move to its normally closed position such that full hydraulic pressure is present in hydraulic line 77 and pilot line 82. The selected pressure threshold of the pilot 80 is exceeded and the counterbalance valve 78 is open to permit pressurized fluid to flow through the counterbalance valve 78 downstream of the hydraulic motors 50 and 62 and therefore also to flow through and drive the hydraulic motors 50 and 62 to feed material by the feed rolls 38 and 40 into the chipper 22 (FIG. 3).

If the load of material being fed by the feed rolls 38 and 40 to the chipper 22 is large, the chipper 22 will load down and slow the engine 18. If the feed rolls 38 and 40 are not completely stopped, inefficient chipping and rubbing or frictional burning of the material can occur and the engine may be killed by the load. The desired operating range for engine horsepower and rpm is illustrated diagrammatically in FIG. 5. The speed switch 64 is adjusted to open when the engine rpm is equal to or greater than the upper set point, indicated by the line at 84, and to close when engine rpm slows to equal or below the lower reset point, indicated by the line at 86. In accordance with the foregoing description of the control system, the speed switch 64 will close the solenoid valve 72, thereby permitting the feed rolls to be driven by the hydraulic motors 50 and 62 (FIG. 4), when the upper set point 84 of engine rpm has been met or exceeded. If the feeding action of the feed rolls is too aggressive for the chipping machine given the material being chipped, the engine will load down until the engine rpm slows to the lower reset point 86, whereupon the speed switch 64 will close to energize and open the solenoid valve 72 (FIG. 4). As described previously, opening of the solenoid valve 72 results in closing of the counterbalance valve 78 which acts as a brake on the hydraulic motors 50 and 62, thus stopping the feed rolls. With the feed rolls stopped, the engine rpm will recover to at least the upper set point 84, whereupon the speed switch 64 will open to de-energize and close the solenoid valve 72. The counterbalance valve 78 then opens and the feed rolls are driven by the hydraulic motors 50 and 62 to again feed material into the chipper.

Figure 5:
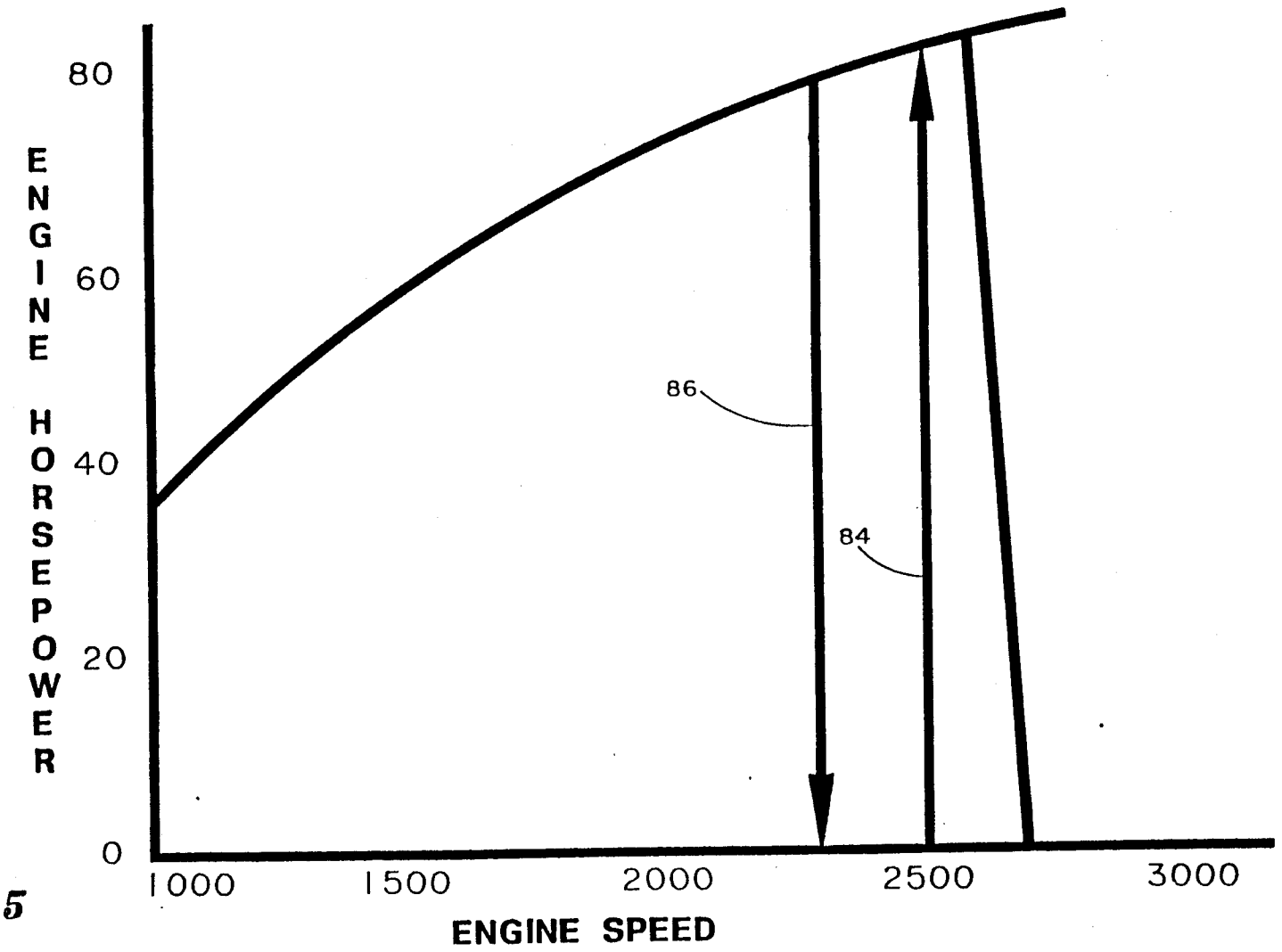
FIG. 5 is a diagram of engine horsepower against engine speed showing the preferred operating range for the chipper disk drive engine.

In the preferred embodiment, the engine 18 is a Perkins Model 4.236 Diesel engine. It has a maximum no load rpm of 2640 and maximum intermittent horsepower of 80 hp. The speed switch 64 is a Model ESSE-1 available from Synchro-Start Products, Inc., Niles, Illinois. It is adjusted so that the upper set point 84 is 2500 rpm and the lower reset point 86 is 2350 rpm (FIG. 5). A suitable counterbalance valve 78 is available from Modular Controls, Villa Park, Illinois, Model MCVI. At a nominal hydraulic fluid system pressure of 2500 psi, the threshold pressure of the pilot 80 is set at a one-fourth ratio or 625 psi.

Although the invention has been described with respect to a preferred embodiment thereof, it is to be understood that it is not to be so limited since changes and modifications can be made therein which are within the full intended scope of the invention as defined in the appended claims.

I claim:

1. A material feed control mechanism for a wood or brush chipping machine having a pair of coacting feed rolls for feeding material to be chipped into a rotating chipper driven by an engine of variable speed, comprising:

(a) a hydraulic pump driven by the engine for supplying pressurized hydraulic fluid;

(b) a pair of hydraulic motors, one of which is drivably connected to each of the feed rolls and which are driven by said pressurized hydraulic fluid; and (c) valve control means downstream of said hydraulic motors operable to brake and stop said motors in response to a selected low level of pressure in said hydraulic fluid and operable to actuate said motors in response to a selected high level of pressure in said hydraulic fluid.

2. A material feed control mechanism as defined in claim 1, wherein said control means comprises:

(a) a shunt valve between an open position and a closed position for reducing at least to said selected low level the pressure of said hydraulic fluid to said valve means when moved to said open position and for returning to at least said selected high level the pressure of said hydraulic fluid to said valve means when moved to said closed position.

3. A material feed control mechanism as defined in claim 2, wherein said control means comprises:

(a) shunt valve control means for opening said shunt valve when the speed of the engine is loaded below a selected low value and for closing said shunt valve when the speed of the engine returns to a selected high value.

4. A material feed control mechanism as defined in claim 1 wherein said valve means comprises a motion control valve.

5. A method of material feed control for a wood or brush chipping machine having a pair of coacting feed rolls for feeding material to be chipped into a rotating chipper driven by an engine of variable speed, comprising the steps of:

(a) providing a pair of hydraulic motors, one of which is drivably attached to each of the feed rolls;

(b) a hydraulic pump driven by the engine for supplying pressurized hydraulic fluid to drive said hydraulic motors;

(c) actuating said hydraulic motors by opening of a valve means downstream of said hydraulic motors and interrupting said hydraulic motors by closing said valve means; and (d) opening said valve means when the pressure of said hydraulic fluid to said hydraulic motors is at least at a preselected high level and closing said valve means when said pressure is below a selected low level.

6. A method as defined in claim 5 wherein the pressure of hydraulic fluid to said hydraulic motors is dropped below said selected low level if the speed of the engine drops below said selected low value and is raised to at least said selected high level when the speed of the engine recovers to at least said selected high value.

7. A method as defined in claim 5 wherein said valve means comprises a motion control valve.

8. A material feed control mechanism for a wood or brush chipping machine having a pair of coacting feed rolls for feeding material to be chipped into a rotating chipper driven by an engine of variable speed, comprising:

(a) a hydraulic pump for providing a supply of pressurized hydraulic fluid;

(b) a hydraulic motor for driving each of the feed rolls;

(c) a flow divider for directing an equal supply of said pressurized fluid to each of said hydraulic motors;

(d) means for monitoring the speed of the engine;

(e) first valve means operable by said speed monitoring means for interrupting the supply of said pressurized hydraulic fluid to said flow divider if the speed of the engine drops below a preselected limit; and (f) second valve means connected across said hydraulic motors and said flow divider for stopping the flow of hydraulic fluid through said hydraulic motors to brake the feed rolls when said supply of hydraulic fluid to said flow divider is interpreted.

9. The control mechanism as defined in claim 8 wherein said first valve means is operable by said speed monitoring means to restore the supply of said hydraulic fluid if the speed of the engine which has dropped below said preselected level is restored above a second preselected level.

10. The control mechanism as defined in claim 8 wherein said second valve means is a pilot-controlled counterbalance valve.

* * * * *